US006762741B2

(12) United States Patent
Weindorf

(10) Patent No.: US 6,762,741 B2
(45) Date of Patent: Jul. 13, 2004

(54) AUTOMATIC BRIGHTNESS CONTROL SYSTEM AND METHOD FOR A DISPLAY DEVICE USING A LOGARITHMIC SENSOR

(75) Inventor: Paul Fredrick Luther Weindorf, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 487 days.

(21) Appl. No.: 09/747,597

(22) Filed: Dec. 22, 2000

(65) Prior Publication Data

US 2002/0118182 A1 Aug. 29, 2002

(51) Int. Cl.[7] ..... G09G 3/28

(52) U.S. Cl. ..... 345/102; 345/207; 345/690; 349/61

(58) Field of Search ..... 345/87, 88, 204, 345/211, 102, 207, 690; 315/149, 150, 307; 349/61, 64, 114

(56) References Cited

U.S. PATENT DOCUMENTS 5,428,265 A * 6/1995 Booth, Jr. et al. ..... 315/158
5,754,013 A * 5/1998 Praiswater ..... 315/307
6,144,359 A * 11/2000 Grave ..... 345/102
6,201,554 B1 * 3/2001 Lands ..... 345/169
6,246,862 B1 * 6/2001 Grivas et al. ..... 455/90
6,252,355 B1 * 6/2001 Meldrum et al. ..... 315/150
6,300,931 B1 * 10/2001 Someya et al. ..... 345/102
6,411,306 B1 * 6/2002 Miller et al. ..... 345/690

* cited by examiner

*Primary Examiner*—Amr Ahmed Awad
(74) *Attorney, Agent, or Firm*—Brinks Hofer Gilson & Lione

(57) ABSTRACT

This invention provides an automatic brightness control system for display devices, which may have a lighted display, a sensor, and control circuitry. The sensor logarithmically generates a first signal in response to the ambient light near the lighted display. The control circuit selects a display luminance from one or more luminance adjustment sequences having essentially constant ratio steps. The display luminance is a fractional power function of the ambient light near the display. The fractional power function may be adjusted by a constant luminance ratio offset.

63 Claims, 2 Drawing Sheets

AUTOMATIC BRIGHTNESS CONTROL SYSTEM AND METHOD FOR A DISPLAY DEVICE USING A LOGARITHMIC SENSOR

CROSS REFERENCE TO RELATED APPLICATIONS

The following co-pending and commonly assigned U.S. patent applications have been filed on the same day as this application. All of these applications relate to and further describe other aspects of the embodiments disclosed in this application and are incorporated in this application by reference in their entirety.

U.S. patent application Ser. No. 09/748,528, "BRIGHTNESS OFFSET ERROR REDUCTION SYSTEM AND METHOD FOR A DISPLAY DEVICE," filed on Dec. 22, 2000 , and is now U.S. Pat. No. 6,396,217.

U.S. patent application Ser. No. 09/748,615, "VARIABLE RESOLUTION CONTROL SYSTEM AND METHOD FOR A DISPLAY DEVICE," filed on Dec. 22, 2000, and is now U.S. Pat. No. 6,563,479.

FIELD OF THE INVENTION

This invention generally relates to brightness controls for display devices. More particularly, this invention relates to automatic brightness control systems for display devices utilizing brightness adjustment.

BACKGROUND OF THE INVENTION

Display devices are used in a variety of consumer and industrial products to display data, charts, graphs, messages, other images, information, and the like. Backlight display devices, which may be backlit or frontlit, have a backlight positioned to provide light for a display panel. Emissive display devices have pixels that are the emissive light source. In emissive displays, the pixel light source may be a CRT phosphor, a FED phosphor, a light emitting diode (LED), an organic LED, an electroluminescent, or any emissive display technology. In backlight display devices, the backlight may be a fluorescent tube, an electroluminescent device, a gaseous discharge lamp, a plasma panel, LED, and the like. The display panel may be a light emitting diode (LED) and may be a passive or active matrix liquid crystal display (LCD). The backlight and display panel are connected to control circuitry, which is connected to a voltage supply. The display device may be separate or incorporated with other components, such as a dashboard in an automobile or other vehicle, a portable electronic device, and the like.

Generally, the brightness of the display panel is controlled in relation to the environment of the display device and user preferences. A poorly lit environment usually requires less brightness than a brightly lit environment. Also, a brightness level suitable for one user may not be suitable for another user. In a typical display device, a user adjusts the brightness manually. There may be a switch, a keypad, a touch screen, a remote device, or the like to adjust the brightness. The brightness usually remains at the fixed level until the user changes the level.

A fixed brightness level may be suitable when there is consistent ambient light during operation of the display device or when a user need only make an occasional adjustment. However, in many applications, a fixed brightness level may not be suitable and may not be desirable. Ambient light seems to constantly change or changes very frequently in many applications such as automobiles and other vehicles or in portable applications. There are the extremes of night and day and in-between conditions such as dusk and dawn. Other in-between conditions include brightly lit highways at night and tunnels during the day. There also are differences in the ambient light on cloudy and sunny days. The changes in ambient light conditions may similarly affect other applications using backlight display devices, such as cellular telephones and other communication devices, personal organizers, laptop and personal computers, other portable electronic devices, and the like. Some applications use a display device in various locations having different ambient light conditions. These locations may include an office, the outdoors, inside a vehicle, and the like. The different ambient light conditions usually require adjustments to the brightness level for comfortable viewing of the display device. Additionally, automatic adjustments to the brightness level may improve battery consumption, improve light source life, and minimize image burn-in (image retention) such as occurs with emissive displays such as organic LEDs, plasma, FEDs and the like.

In automotive applications, one approach is to reduce the brightness of a backlight display device when the headlights are switched-on. A user may further adjust the brightness manually. There essentially are two brightness "levels"—a first level when the lights are switched-off and a second, lower level or range when the lights are switch-on. However, this approach does not automatically change the brightness in relation to changing ambient light conditions. Additionally, there may be unsuitable brightness levels for particular ambient light conditions. The brightness level may be too low at dusk or on a cloudy day when the lights are switched-on. Generally, the two-level and manual adjustment is not well suited for uses of backlight display devices in automotive applications, especially those devices conveying large amounts of detailed information such as maps and other navigation features, internet messages, other communications, and the like.

In addition, brightness adjustments that are exponential in nature provide less luminance change at lower display luminance levels and more luminance change at higher display luminance levels. The logarithmic nature of the human eye perceives equal luminance step ratios as equal brightness steps. To a user, a luminance change from about 10 Nits to 12 Nits (a ratio of about 1.2) appears like the same luminance change from about 100 Nits to 120 Nits (a ratio of about 1.2). A Nit is a unit of luminance for light reflected, transmitted, or emitted by a surface, such as a display panel. Brightness adjustments that do not correspond to the perception capability of the eye often result in different brightness levels than what is needed or desired. For example, a display device may have a daytime brightness range from 50 to 450 Nits. A brightness control system which linearly increases the brightness as a function of a control device such as a potentiometer or brightness step controller would be too sensitive for low brightness levels and not sensitive enough for the higher brightness levels. This brightness range may have about 8 steps, with each step increasing the brightness by about 50 Nits.

In contrast, brightness control systems that control the display luminance as a function of ambient light and in relation to the preferred human eye transfer function are different in comparison to manual adjustment requirements. The function is essentially a straight line on a log-log scale where the ordinate (Y axis) is the emitted display luminance and the abscissa is the reflected ambient light from the display. The slope and offset of the straight-line transfer function on the log-log scale is a function of the display type.

Automatic brightness control systems that do not follow this function may provide too little or too much brightness than what is needed for comfortable viewing. If the brightness is too little, the user may not be able to see the display device. If the brightness is too much, the "excess" brightness may provide an uncomfortably bright display. The excess brightness increases the power consumption, reduces efficiency, and increases the operating costs of the display device. The excess brightness also reduces the operating life of the display device and will accelerate image burn in for emissive type display devices. Generally, the higher the brightness and the longer the time at a higher brightness, both tend to reduce the operating life of the display and for portable devices increases the battery consumption rate. During direct sunlight or similar ambient light conditions, the brightness level is set at or near the maximum brightness level for a user to see the display device. However, the brightness level does not need to be at the maximum level all the time as may be the case in diffused ambient light conditions where the sunlight is not directly impinging on the display.

Many automatic brightness control systems frequently attempt to use a linear method that proportionally changes the display brightness as a function of the sensed ambient light. Such a system may have a lower than desired display luminance except at the end points and may be especially dim at the lower ambient lighting levels. This is because the user desired straight line transfer function on a log-log scale is a fractional power function which requires that the brightness to increase rapidly at lower ambient light levels and then increase more slowly as the ambient light level increases to a maximum level. The linear adjustments also may provide too little brightness than what is needed for comfortable viewing.

SUMMARY

This invention provides an automatic brightness control system for a display device. The brightness control system adjusts the display luminance of the display panel as a fractional power function of the ambient light impinging on the display panel. The manual brightness or luminance adjustments, including preference offsets to the automatic brightness control transfer function on a log-log plot, have essentially constant ratio steps, enabling a user to perceive the adjustments as equal brightness changes. By implementing a user preference offset adjustment using constant ratio luminance steps, the automatic brightness control system may be adjusted in a manner to suit one or more viewing preferences.

In one aspect, a display device having an automatic brightness control system may have a lighted display, a sensor, and control circuitry. The sensor is disposed to logarithmically sense ambient light near the lighted display. The control circuitry is connected to receive a first signal from the sensor. The control circuitry also is connected to provide a display luminance to the lighted display. The control circuitry selects the display luminance from at least one luminance adjustment sequence. Each luminance adjustment sequence has a plurality of luminance values with constant ratio steps. The display luminance is a fractional power function of the ambient light near the lighted display.

In another aspect, a display device having an automatic brightness control system may have a lighted display, a sensor, a user interface, and control circuitry. The sensor is disposed to logarithmically sense ambient light near the lighted display. The control circuitry is connected to receive a first signal from the sensor and connected to receive at least one user selection from the user interface. The control circuitry also is connected to provide a display luminance to the lighted display. The control circuitry selects the display luminance from at least one luminance adjustment sequence. Each luminance adjustment sequence has a plurality of luminance values with constant ratio steps. The display luminance is a fractional power function of the ambient light near the lighted display. The fractional power function is adjusted by a constant ratio offset based on the at least one user brightness selection.

In one method for controlling the brightness of a display device, a first signal is generated in response to the ambient light associated with a lighted display. A display luminance is selected from one or more luminance adjustment sequences. Each luminance adjustment sequence has multiple luminance values with constant ratio steps. The display luminance is provided to the lighted display. The display luminance is a fractional power function of the ambient light associated with the lighted display.

In another method for controlling the brightness of a display device, one or more user brightness selections are determined. A first signal is generated in response to the ambient light associated with a lighted display. A display luminance is selected from one or more luminance adjustment sequences. Each luminance adjustment sequence has multiple luminance values with constant ratio steps. The display luminance is provided to the lighted display. The display luminance is a fractional power function of the ambient light near with the lighted display. The fractional power function is adjusted by a constant luminance ratio offset based on the at least one user brightness selection.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 2:
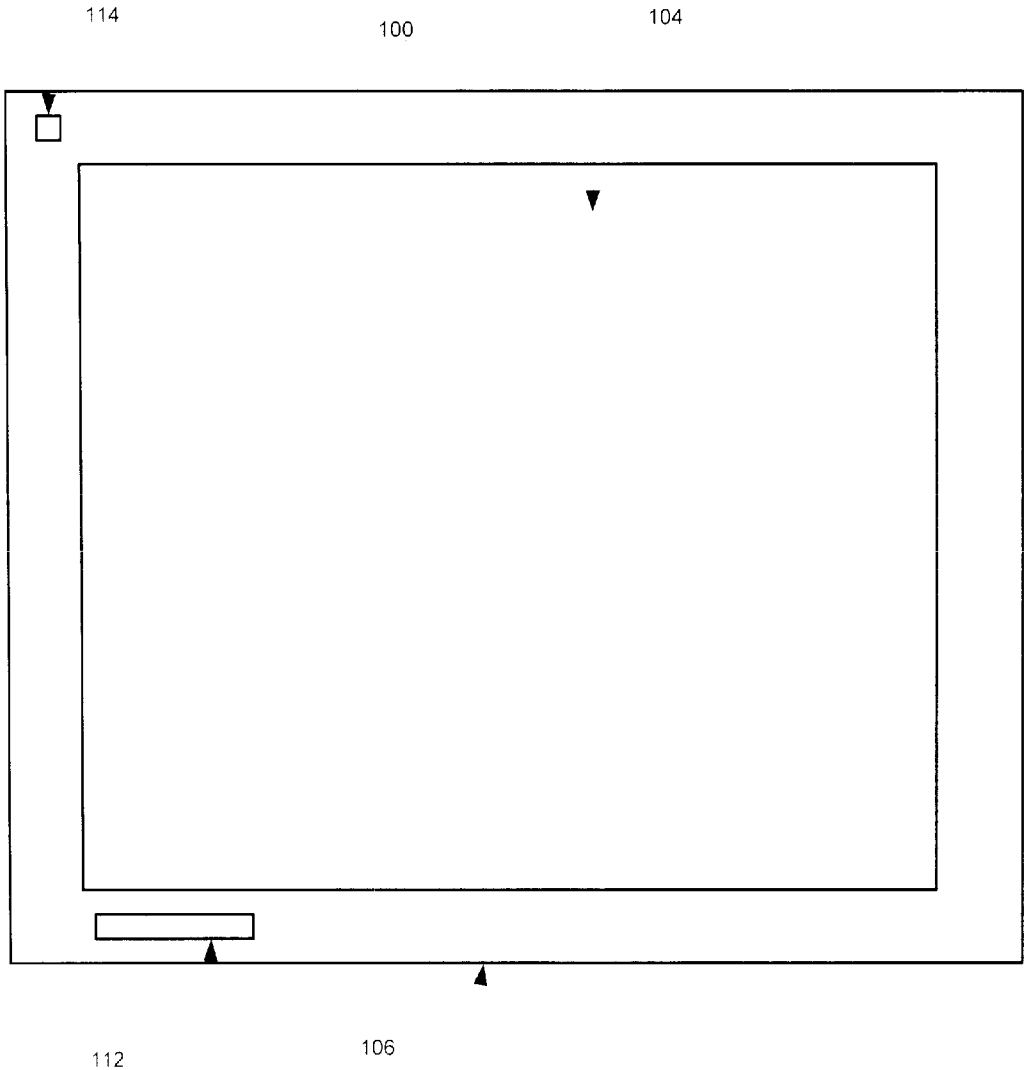
FIG. 2 is a representative front view of the backlight display device shown in FIG. 1.
Figure 1:
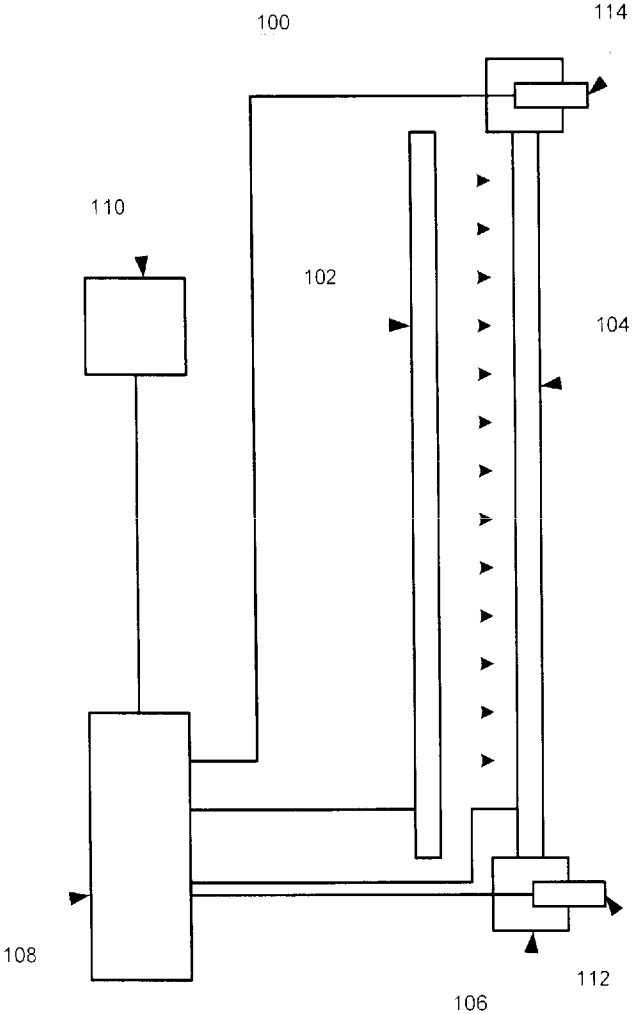
FIG. 1 is a representative side view of one embodiment of a backlight display device having an automatic brightness control system.

FIGS. 1 and 2 represent a backlight display device 100 having an automatic brightness control system. FIG. 1 shows a side view of the backlight display device 100. FIG. 2 shows a front view of the backlight display device 100. In this embodiment, the backlight display device 100 includes a backlight 102, a display panel 104, a bezel 106, control circuitry 108, a voltage supply 110, a user interface 112, and a logarithmic sensor 114. The backlight display device 100 may have different, additional or fewer components and different configurations.

The backlight display device 100 may provide a reverse image for rear projection, may project an image onto a display surface (not shown), may have one or more magnification lens (not shown) and reflective surfaces (not show), may work with or have other components, and the like. The backlight display device 100 may be incorporated in a navigation radio system for an automobile or other vehicle. The backlight display device 100 may be built-in or integrated with a dashboard, control panel, or other part of an automobile or other vehicle. The backlight display device 100 also may be built-in or integrated with an electronic device, such as a laptop computer, personal organizer, and the like. Additionally, the backlight display device 100 may be separate or a separable component. While configurations and modes of operation are described, other configurations and modes of operation may be used.

In one aspect, the backlight 102 and the display panel 104 form a liquid crystal display (LCD). The backlight 102 and the display panel 104 may be a passive or active matrix LCD and may comprise another type of lighted display, which may be a backlit or front lit display and may be an emissive display such as an LED or other pixel light source. The backlight 102 and the display panel 104 may provide monochrome, color, or a combination of monochrome and color. In this aspect, the backlight 102 is a cold cathode fluorescent lamp. The backlight 102 may be one or more aligned fluorescent tubes, electro-luminescent devices, gaseous discharge lamps, light emitting diode (LED), organic LEDs, plasma panels, a combination thereof, and the like. The backlight 102 may include multiple or sub backlights. The display panel 104 may be selected based on the type of backlight and may have multiple or sub display panels. In this aspect, the backlight 102 is operatively disposed to provide light for operation of the display panel 104.

In this embodiment, the bezel 106 extends around and holds the outer perimeter of the display panel 104. The bezel 106 may have various configurations and may extend around part or only a portion of the outer perimeter. The bezel 106 may hold or extend around other components such as the backlight 102. The bezel 106 may include additional bezels and may be connected with or part of another component, such as a dashboard in an automobile.

The control circuitry 108 is connected to operate and to provide an image signal to the backlight 102 and the display panel 104. The control circuitry 108 may include one or more microprocessors and may be part of or incorporated with other circuitry, such as a central processing unit or a vehicle control unit. The control circuitry 108 may be completely or partially provided on one or more integrated circuit (IC) chips. The control circuitry 108 may have other circuitry for control and operation of the backlight display device 100, such as a transceiver, one or more memory devices, and the like. The control circuitry 108 also is connected to a voltage supply 110, which may be provided by an automotive battery or electrical system, another type of battery, a household current supply, or other suitable power source.

Along with other operating parameters and signals, the control circuitry 108 controls or adjusts the luminance of the backlight and consequently the luminance of the display panel 104. In one aspect, the control circuitry 108 provides a brightness command signal to the backlight or similar signal that corresponds to a luminance or brightness value for the desired or selected brightness of the display panel 104. The commanded brightness signal changes the brightness. The control circuitry 108 may generate the image signal and may pass the image signal from another source (not shown). The image signal may be based upon one or more radio signals, one or more signals from a global positioning system (GPS), data stored in a memory device, user inputted data, a combination, and the like.

The user interface 112 enables a user adjust various aspects of the display including contrast, brightness, color, and the like. In one aspect, the user interface 112 is disposed in or on the outer surface of the bezel 106. In this aspect, the user interface 112 is one or more knobs or push buttons, a touch screen, a voice activated system, or other means of user selections. The user interface may be other types of manual controls, electronic input from another device, and the like. The user interface 112 may be located elsewhere, may be incorporated with another controller or user interface, and may be included in a remote control device.

The logarithmic sensor 114 is connected to the control circuitry 108 and is disposed to provide a signal indicative of the ambient light on or near the display panel 104. In one aspect, the logarithmic sensor 114 includes an ambient light sensor, such as a photodiode (not shown) connected to a logarithmic amplifier (not shown). The photodiode provides a sensor signal. The logarithmic sensor 114 may have other components and configurations. The logarithmic sensor 114 may be another type of sensor as long as the sensor may be used to provide brightness adjustments in relation to the capability of a human eye to perceive changes in the brightness. The logarithmic amplifier may be part of the control circuitry 108. In this aspect, the logarithmic sensor 114 is disposed in or on an outer surface of the bezel 106. The logarithmic sensor 114 may be disposed elsewhere as long as a signal indicative of ambient light on or near the display panel 104 is provided. The logarithmic sensor 114 may be temperature compensated and may discriminate between daytime and nighttime conditions for determination of display luminance and control functions. Daytime conditions have ambient light levels in the range of the light levels from dawn until dusk. Nighttime conditions have ambient light levels in the range of the light levels from dusk until dawn. The logarithmic sensor 114 may operate in a dynamic range of lighting conditions, such as conditions encountered in the automotive environment. The logarithmic sensor 114 may have a dynamic range of about four decades of lighting conditions. In one aspect, the logarithmic sensor 114 operates with about five volts from a single positive power supply. The logarithmic sensor 114 may operate with other voltage ranges and with positive and/or negative supplies. The logarithmic sensor 114 may allow use of equal A/D converter steps for each brightness ratio step in the brightness control system.

The automatic brightness control system adjusts the display luminance of the display panel 104 as a function of the ambient light impinging on the display panel. In this embodiment, the logarithmic sensor 114 is disposed to sense ambient light impinging on the bezel 106, which corresponds to ambient light impinging on the display panel 104. The logarithmic sensor 114 may be disposed elsewhere to sense ambient light impinging the display panel 104. A signal representative of the sensed ambient light is filtered or averaged to provide a digitized sensor signal. The digitized sensor voltage is used to select or provide a brightness step number (BSN) or step number (Sn) and a corresponding brightness or luminance value. The step number may be selected from a look-up chart or may be determined from calculations as discussed below. The look-up chart may be based on these calculations, empirical results, or a combination thereof. The brightness or luminance adjustments are based upon the capability of a human eye to perceive changes in brightness. The human eye perceives brightness changes in essentially constant ratio steps, which are nonlinear and logarithmic. A brightness change from 1 nit to 1.2 nits is perceived as equal to a brightness change from 100 nits to 120 nits (both changes have a constant ratio step of about 1.2 or the inverse). The brightness or luminance adjustments have essentially constant ratio steps, which a user perceives as equal brightness changes. The nonlinear, logarithmic response of the eye allows the visual system to work over many orders of magnitude. Similarly, the brightness control system with a constant ratio may provide adjustments over many orders of magnitude.

In one aspect, the luminance values for adjusting or controlling the brightness are arranged as sequential steps in one or more brightness adjustment sequences. In each sequence, the brightness adjustment steps may be arranged from the lowest or minimum luminance value to the highest or maximum luminance value or vice versa. The minimum and maximum luminance values may correspond to the operating limits of the display panel 104, the operating limits of the photodiode or other components, the extent of daytime or nighttime light conditions, and the like. There may be separate brightness adjustment sequences for manual, automatic, day, night, a combination thereof, and other luminance factors. Each step or luminance value in a brightness adjustment sequence may have a corresponding brightness step number (BSN) or step number (Sn). When multiple brightness adjustment sequences are used or provided, a BSN may correspond to luminance values in two or more of the sequences.

Each brightness adjustment sequence may have one or more constant ratio steps. A constant ratio step is when the ratio of a first pair of sequential luminance values is essentially the same as the ratio of a second pair of sequential luminance values. The first and second pairs may have a common luminance value. Each brightness adjustment sequence may have constant ratio steps for essentially all pairs of sequential luminance values. In one aspect, each brightness adjustment sequence has constant ratio steps for all pairs of sequential luminance values or all values except for one or more pairs including a luminance value at or near the minimum and maximum luminance values for the sequence. Variable ratio steps may also be used.

There may be any number of brightness adjustment steps in a brightness adjustment sequence. The brightness adjustment may become coarser as fewer steps are used. Similarly, the brightness adjustment may become finer as more steps are used. In one aspect, the number of brightness adjustment steps is in the range of about 5 through about 50. The number of brightness steps may vary depending upon the type of brightness adjustment sequence. A manual or night brightness adjustment sequence may have fewer steps than an automatic or day brightness adjustment sequence.

In one aspect, the automatic brightness control system uses a fractional power function to adjust the display brightness as a function of the ambient light condition. The fractional power function may have the form of a straight line on a log-log scale relating emitted display luminance to ambient luminance. At low illumination ambient light levels, the desired display luminance increases rapidly at first and then more slowly as the ambient illumination approaches the maximum value. By sensing the ambient illumination in a logarithmic fashion, the fractional power function may be implemented by mapping essentially equal logarithmic light changes to the constant step brightness ratios. This mapping relationship may be performed in concert with the logarithmic sensor 114 to produce the fractional power function for automatic brightness control. In a further aspect, this mapping function may be performed with manual adjustments or other fine-tuning to the automatic control by arranging the steps as constant luminance ratios to produce a user-desired fractional power function for automatic brightness control.

Table 1 shows step numbers (Sn) with corresponding night and day luminance adjustment sequences and with corresponding output values from the photodiode and the logarithmic amplifier. The night steps may be selected based on step number information from a master instrument panel control or the like. The day levels are selected based on the value from the logarithmic sensor. For both day and night levels the user may manually offset (+ or −) from a "normal" step value for a user preference. The manual adjustment offset may be any number of steps. In one aspect, the manual adjustment is in the range one step through five steps. In another aspect, the manual adjustment is up to four steps. The step numbers (col. 1) range from −3 to 44. The day luminance or brightness values range from the lowest luminance value for daytime ambient light to the highest luminance value for the backlight display device. The step numbers also correspond to the night luminance values (col. 2). There are no night luminance values for ambient light sensor values 26 and above. Step numbers are available below the value corresponding to the ambient light sensor value 26 for a manual adjustment offset of up to four steps.

The night luminance or brightness values range from the lowest luminance value for the display device to the highest luminance value for nighttime based on the master dimming control for the instrument panel. Step numbers −3 through 1 have the same night luminance value because 0.5 nits is the lowest luminance value for the backlight display device. Step numbers −3 through 0 are for the manual adjustment below the nighttime or daytime normal minimum values. Step numbers 22 through 25 have the same night luminance value—the highest luminance value for nighttime. The step numbers for day correspond to the output from the photodiode and logarithmic amplifier.

TABLE 1

AUTOMATIC BRIGHTNESS ADJUSTMENTS

| Step Number (Sn) | Automatic Night Luminance (nits) | Automatic Day Luminance (nits) | Photodiode (Amps) | Logarithmic Amplifier |
|---|---|---|---|---|
| −3 | 0.500 | 66.79 | | |
| −2 | 0.500 | 69.75 | | |
| −1 | 0.500 | 72.84 | | |
| 0 | 0.500 | 76.06 | | 0–25 |
| 1 | 0.500 | 79.43 | 7.14E-09 | 26 |
| 2 | 0.635 | 82.95 | 8.27E-09 | 30 |
| 3 | 0.807 | 86.62 | 9.57E-09 | 34 |
| 4 | 1.025 | 90.46 | 1.11E-08 | 38 |
| 5 | 1.303 | 94.46 | 1.28E-08 | 42 |
| 6 | 1.655 | 98.64 | 1.49E-08 | 46 |
| 7 | 2.102 | 103.01 | 1.72E-08 | 50 |
| 8 | 2.671 | 107.57 | 2.00E-08 | 54 |
| 9 | 3.393 | 112.34 | 2.31E-08 | 58 |
| 10 | 4.311 | 117.31 | 2.68E-08 | 62 |
| 11 | 5.477 | 122.50 | 3.10E-08 | 66 |
| 12 | 6.959 | 127.93 | 3.59E-08 | 70 |
| 13 | 8.841 | 133.59 | 4.16E-08 | 74 |
| 14 | 11.232 | 139.51 | 4.82E-08 | 78 |
| 15 | 14.269 | 145.69 | 5.58E-08 | 82 |

TABLE 1-continued

AUTOMATIC BRIGHTNESS ADJUSTMENTS

| Step Number (Sn) | Automatic Night Luminance (nits) | Automatic Day Luminance (nits) | Photodiode (Amps) | Logarithmic Amplifier |
|---|---|---|---|---|
| 16 | 18.128 | 152.14 | 6.46E-08 | 86 |
| 17 | 23.031 | 158.87 | 7.48E-08 | 90 |
| 18 | 29.260 | 165.91 | 8.67E-08 | 94 |
| 19 | 37.173 | 173.25 | 1.00E-07 | 98 |
| 20 | 47.227 | 180.92 | 1.16E-07 | 102 |
| 21 | 60.000 | 188.94 | 1.35E-07 | 106 |
| 22 | 65.439 | 197.30 | 1.56E-07 | 110 |
| 23 | 65.439 | 206.04 | 1.81E-07 | 114 |
| 24 | 65.439 | 215.16 | 2.09E-07 | 118 |
| 25 | 65.439 | 224.69 | 2.42E-07 | 122 |
| 26 | | 234.64 | 2.81E-07 | 126 |
| 37 | | 245.03 | 3.25E-07 | 130 |
| 38 | | 255.88 | 3.76E-07 | 134 |
| 29 | | 267.21 | 4.36E-07 | 138 |
| 30 | | 279.04 | 5.05E-07 | 142 |
| 31 | | 291.39 | 5.85E-07 | 146 |
| 32 | | 304.30 | 6.77E-07 | 150 |
| 33 | | 317.77 | 7.85E-07 | 154 |
| 34 | | 331.84 | 9.09E-07 | 158 |
| 35 | | 346.53 | 1.05E-06 | 162 |
| 36 | | 361.88 | 1.22E-06 | 166 |
| 37 | | 377.90 | 1.41E-06 | 170 |
| 38 | | 394.63 | 1.64E-06 | 174 |
| 39 | | 412.11 | 1.89E-06 | 178 |
| 40 | | 430.36 | 2.19E-06 | 182 |
| 41 | | 449.41 | 2.54E-06 | 186 |
| 42 | | 469.31 | 2.94E-06 | 190 |
| 43 | | 490.09 | 3.41E-06 | 194 |
| 44 | | 511.79 | 3.95E-06 | 198 |

In Table 1, the day luminance or brightness adjustment sequence and the night luminance or brightness adjustment sequence each have constant ratio steps. For example, the day luminance values for steps 4 and 5 have essentially the same ratio (about 1.044 or its inverse) as the day luminance values for steps 15 and 16. As another example, the night luminance values for steps 8 and 9 have essentially the same ratio (about 1.27 or its inverse) as the night luminance values for step numbers 17 and 18. Other values in each of the luminance adjustment ranges have similarly constant ratio steps.

The brightness control system may adjust the daytime brightness automatically in response to changes in ambient light. In one aspect, the digitized sensor signal from the logarithmic sensor 114 is compared to the logarithmic amplifier values in Table 1. The step number for the digitized sensor signal having a value nearest the logarithmic amplifier value in Table 1 is selected as the step number. The selected step number has a corresponding day luminance value. In one aspect and depending upon whether it is night or day, the brightness level is adjusted according to the night or day luminance value for the step number. In another aspect, a user may override or adjust the luminance to increase or decrease the brightness according to a user preference. The step number is increased or decreased to use a different luminance value that increases or decreases the brightness level. In one aspect, the selected step number is changed in response to user input by up to four step numbers. In this aspect, if step number 16 is selected, then the user may adjust the step number to between 12 and 20. The selected step number also may be adjusted in relation to other operating parameters, such the dimming level of interior lights or whether the headlights are on in an automobile or other vehicle.

A user also may decline to use the automated brightness control as previously discussed. The user may select a manual mode. Table 2 shows step numbers (Sn) along with corresponding night and day luminance adjustment sequences for manual selection of brightness. The night and day luminance adjustment sequences each have constant ratio steps as previously discussed. In this embodiment, the luminance adjustment sequences each have nine luminance values with corresponding step numbers (col. 1). These sequences provide a user with nine levels of manual brightness adjustment for daytime and nighttime conditions. The sequences may have other ranges of luminance values. The day luminance values range from the lowest luminance value for daytime ambient light to the highest luminance value for the backlight display device. The night luminance values range from the lowest luminance value for the display device to the highest luminance value for nighttime ambient light. The brightness level is adjusted according to the night or day luminance value for the step number selected by the user.

TABLE 2

MANUAL BRIGHTNESS ADJUSTMENTS

| Step Number Selected (Sn) | Manual Night Luminance (nits) | Manual Day Luminance (nits) |
|---|---|---|
| 1 | 0.500 | 50.00 |
| 2 | 0.910 | 66.87 |
| 3 | 1.655 | 89.44 |
| 4 | 3.011 | 119.61 |
| 5 | 5.477 | 159.97 |
| 6 | 9.965 | 213.95 |
| 7 | 18.128 | 286.15 |
| 8 | 32.980 | 382.70 |
| 9 | 60.000 | 511.83 |

In one aspect, the brightness control system provides a user adjustable power function control. The power function governing automatic brightness control may be a function of display illuminance or the amount of light impinging on the display. The display emitted luminance or brightness may change as a fractional power of the display background illuminance, which becomes a display background luminance due to the reflectivity of the display. This relationship may be described by the following equation regarding automatic luminance control:

$$B=Bo\cdot BGL^{C} \quad \text{(Eqn. 1)}$$

where B is the display emitted luminance or brightness, Bo is a constant corresponding to a brightness offset on a log-log plot of equation 1, BGL is the display background luminance due to reflected ambient light and where C is an exponent describing the slope of the equation 1 on a log-log plot and may be represented by $0<C<1$ or a positive fraction. This slope may be indicative of the human visual system and may have a value dependent upon the display technology.

The relation of constant ratio steps may be expressed by the following equation:

$$B_N = \frac{B\max}{\left[\frac{B\max}{B\min}\right]^{((T-N)/(T-1))}} \quad \text{(Eqn. 2)}$$

where $B_N$ is a selected brightness that yields constant brightness ratios for B, Bmax is the maximum display brightness, Bmin is the minimum display brightness, which may be the minimum daytime or other brightness, T is the total number of brightness steps in the automatic or manual brightness table, and N is a brightness step number (BSN) or step number (Sn) describing which of the T brightness steps is to be used.

By combining equations 1 and 2 and solving for $BGL_N$, the quantum background luminance yields:

$$BGL_N = \left[\frac{B\max}{Bo \cdot \left[\frac{B\max}{B\min}\right]^{((T-N)/(T-1))}}\right]^{(1/c)} \quad \text{(Eqn. 3)}$$

From equation 3, there is a direct correlation between step number N and the background luminance $BGL_N$. When the measured and derived background luminance increases from $BGL_N$ to $BGL_{N+1}$, the selected brightness step is increased from N to N+1. This results in the brightness increasing from $B_N$ to $B_{N+1}$ as determined by equation 2.

Using equations 2 and 3, a table such as Table 1 may be constructed that relates the step number N, brightness values $B_N$, and the background luminance $BGL_N$. The total number of brightness steps T may be arbitrary and may depend on the possible coarseness of the brightness steps provided by the display device. Using equation 2, the brightness levels $B_N$ for each step are determined for each step number value N. Finally, for each step number N, the $BGL_N$ values are calculated. This table is used by first measuring the BGL, by finding the closest $BGL_N$, and by commanding the display brightness with the corresponding $B_N$ value. The result is a background luminance fractional power function. Additionally, each brightness step looks the same to a user since each step has a constant brightness ratio.

Referring to Table 1, the BGL or background luminance may be directly proportional to the light measured by the logarithmic sensor and converted into current (amps). The photodiode current may be converted into a logarithmic voltage value, which may be digitized into a digital value by the analog-to-digital converter (ADC). The digital value is compared to the logarithmic amplifier values. In one aspect, the step number of the logarithmic amplifier value closest to the digital value is selected and subsequently, the automatic day luminance value thus correlated to the measured light is displayed. In this aspect, the logarithmically converted current provides essentially equal ADC steps as mathematically described below. Essentially equal ADC steps over the dynamic range help prevent the resolution of the ADC from being exceeded.

To add the capability for user preference adjustment, equation 3 is modified by substituting N+(So−SNS) for N(Sn). The resultant equation allows the user to adjust the power function by brightness ratios by adding or subtracting an integer offset to the brightness step number pointer, N.

$$BGL_N = \left[\frac{B\max}{Bo \cdot \left[\frac{B\max}{B\min}\right]^{((T-N-(So-SNS))/(T-1))}}\right]^{(1/c)} \quad \text{(Eqn. 4)}$$

where SNS is a user controlled switch number position or user selected step number for adjusting the automatic brightness function, and $S_o$ is the midpoint of the SNS range.

By manipulating the exponent term of equation 4, equation 5 shows that by offsetting SNS−$S_O$ steps from N, the entire power function is modified by the SNS−$S_O$ brightness step ratios for the user controllable preferences. This amounts to modifying Bo of equation 1 by SNS−$S_O$ brightness step ratios. Therefore Table 1 may be used and the brightness value selection ($B_N$ in the Automatic Day column) may be offset based on the measured background luminance (BGL) by SNS−$S_O$ steps to "fine tune" the display brightness for a user preference.

$$BGL_N = \left[\frac{B\max}{Bo \cdot \left[\frac{B\max}{B\min}\right]^{((SNS-So)/(T-1))} \cdot \left[\frac{B\max}{B\min}\right]^{((T-N)/(T-1))}}\right]^{(1/c)} \quad \text{(Eqn. 5)}$$

As previously described, the brightness value selection ($B_N$) may be offset based on the background luminance (BGL) by SNS−So steps. This automatic luminance control using a precalculated table dramatically reduces the dynamic power function calculations that may be required if the brightness levels were calculated in real time. In one aspect, the brightness control system has sufficient processing power to provide these calculations in real time. The brightness control system may have or use one or more microprocessors to provide this processing. The brightness level may then be calculated using the following equation:

$$B = Bo \cdot \left[\frac{B\max}{B\min}\right]^{((SNS-So)/(T-1))} \cdot BGL^C \quad \text{(Eqn. 6)}$$

The logarithmic amplifier may provide $BGL_N$ values that are spaced by equal amounts. If a linear light sensor is used, the analog-to-digital converter resolution may be problematic at the lower luminance values. The upper levels (as N moves more towards T) use all or almost all of the dynamic range. This may be understood by deriving a formula for $BGL_{N+1}-BGL_N$ or ΔBGL.

$$\Delta BGL = BGL_{N+1} - BGL_N = \left[\frac{B\max}{Bo \cdot \left[\frac{B\max}{B\min}\right]^{((T-N-1)/(T-1))}}\right]^{(1/c)} - \left[\frac{B\max}{Bo \cdot \left[\frac{B\max}{B\min}\right]^{((T-N)/(T-1))}}\right]^{(1/c)} \quad \text{(Eqn. 7)}$$

For large N(e.g. N=T−1), $\Delta B=(B\max/Bo)^{(1/c)}$ which is much greater than ΔB~0 for N=0. The result is little or no resolution at the lower $BGL_N$ values. In contrast, if a logarithmic light sensor is provided, the difference between successive $BGL_N$ values becomes a constant. The number of $BGL_N$ steps between successive brightness steps also becomes a constant. The following equations may be used to show the effect of using a logarithmic light sensor:

$$\Delta\mathrm{Log}(BGL_N)=\mathrm{Log}(BGL_{N+1})-\mathrm{Log}(BGL_N) \quad \text{(Eqn. 8)}$$

$$\Delta\mathrm{Log}(BGL_N) = \mathrm{Log}\left[\left[\frac{B\max}{Bo \cdot \left[\frac{B\max}{B\min}\right]^{((T-N-1)/(T-1))}}\right]^{(1/c)}\right] - \mathrm{Log}\left[\left[\frac{B\max}{Bo \cdot \left[\frac{B\max}{B\min}\right]^{((T-N)/(T-1))}}\right]^{(1/c)}\right] \quad \text{(Eqn. 9)}$$

$$\Delta\mathrm{Log}(BGL_N)=(1/c)\cdot\mathrm{Log}(B\max/B\min)=\mathrm{CONSTANT} \quad \text{(Eqn. 10)}$$

As discussed, if a logarithmic light sensor is used, the difference between brightness steps may be a constant. An exact constant may result if the correct gain is applied to the logarithmic light sensor. Since the steps between $BGL_N$ values are constant, the number of values may be expanded to provide greater resolution. This higher resolution may reduce the brightness step jumps if interbrightness step smoothing is not performed. The use of a logarithmic light sensor also may allow accurate detection of nighttime light conditions, which may be an order of magnitude lower than the lowest daytime values.

An implementation of a logarithmic light sensor and a analog-to-digital converter (ADC) may be described using the following equation:

$$\Delta ADC=(2^{NDAC}-1)A_V(V_T)\ln(R)/(V_R\cdot C) \quad \text{(Eqn. 11)}$$

Where ΔADC is the number of analog-to-digital counts between successive brightness steps, NDAC is the number of total analog-to-digital converter (ADC) bits, $V_T$ is the logarithmic diode kT/q constant, $A_V$ is the logarithmic amplifier gain of the $V_T$ voltage, R is the step ratio for the automatic brightness steps, $V_R$ is the dynamic input voltage range of the ADC, and the fractional power C is the slope of the desired fractional power function. The ADC bits may be eight. The $V_T$ may be temperature compensated. The $V_R$ may depend upon the ADC selected. In one aspect, $V_R$ is about 5 volts. C may be about 0.295 for automotive displays using an active matrix liquid crystal display. With proper selection of the gain or maximum or minimum values, the ΔADC counts between successive brightness steps may be made to be essentially an integer.

For example, if NDAC is 8 bits, $V_R$ is 5 volts, ΔADC is 4 counts, N is 44 brightness steps, $B_{min}$ is 79.43 Nits, and $B_{max}$ is 511.79 Nits, the $A_V\cdot V_T$ gain for the logarithmic amplifier may be calculated as follows:

$$A_V\cdot V_T=(\Delta ADC\cdot V_R\cdot C)/((2^{NDAC}-1)\ln(R))$$

$$R=(B_{max}/B_{min})^{1/(N-1)}=(511.79/79.43)^{1/(44-1)}=1.0442$$

The value of the automatic day brightness step ratios in Table 1 is equal to about 1.0442.

$$A_V\cdot V_T=(4\cdot 5V\cdot 0.295)/((2^8-1)\ln(1.0422))=0.534$$

Accordingly, the logarithmic amplifier design may be accomplished to provide $A_V\cdot V_T=0.534$, then a constant ΔADC of 4 counts may be used.

Figure 3:
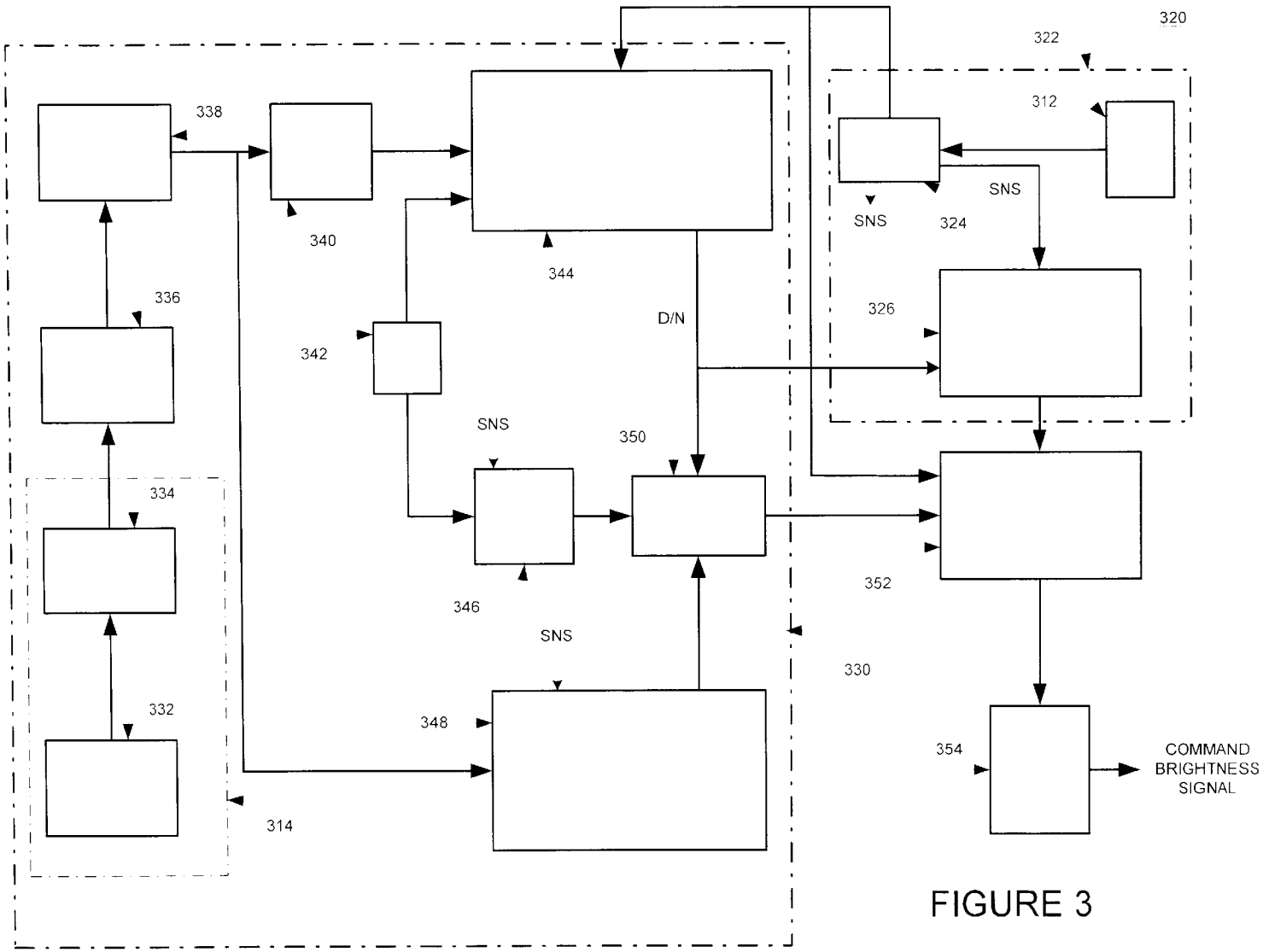
FIG. 3 is a representative block diagram and flowchart of one embodiment of an automatic brightness control system.

FIG. 3 is a representative block diagram and flowchart of an automatic brightness control system 320. The various components in the automatic control system 320 may be hardware, software, or combinations of hardware and software. Other configurations may be used. The automatic brightness control system 320 has a manual adjustment portion 322 and an automatic adjustment portion 330, which provide inputs to a manual/automatic multiplexer 352.

The manual/automatic multiplexer 352 provides a digitized command brightness signal that corresponds to a desired or selected brightness level for the backlight display device. In one aspect, the manual/automatic multiplexer 352 may provide the digitized command brightness signal to digital-to-analog circuitry (DAC) 354. The manual/automatic multiplexer 352 may set the brightness levels for the DAC 354. The DAC 354 may have one or more digital-to-analog converters (not shown), which may be configured to increase the brightness control resolution as the brightness level decreases. The DAC 354 also may have a voltage divider (not shown) for use to further extend the resolution and to reduce the offset error from multiple digital-to-analog converters. The DAC 354 converts the digitized command brightness signal into an analog command brightness signal for controlling the brightness of the backlight or the brightness of the display device.

The manual adjustment portion 322 includes a user interface 312, a brightness selection decoder 324, and a manual brightness selector. The user interface 312 may be push buttons, a touch screen, a remote device, or any other device suitable for a user to provide user brightness selections. The user interface 312 is connected to the brightness selection decoder 324.

The brightness selection decoder 324 determines user brightness selections based on input from the user interface 312. In one aspect, the user brightness selections include an operating mode and a step number selection (SNS). In this aspect, the operating mode may be manual, automatic, day, night, or a combination thereof. There may be other or different modes. A default mode may be automatic at power-up. Other default modes may be used. In this aspect, the SNS has a range of 1 through 9, with 9 being the highest brightness. Other ranges of the SNS may be used and 1 may be the highest brightness. Other brightness selections may be used. The default SNS may be the selection previously chosen or the selection prior power-down. Other default SNS may be used. In this aspect, the brightness selection decoder 324 provides the mode to the automatic adjustment portion 330 and to the manual/automatic multiplexer 352. The brightness selection decoder 324 provides the SNS to the manual brightness selector 326.

The manual brightness selector 326 determines a manual luminance value, which may be a digitized value. The manual luminance value is based on the SNS selected at the user interface 312. As discussed, the number of SNS is nine. The luminance values of the nine SNS are selected to "step" between the minimum and maximum brightness levels. Due to the logarithmic response of the human visual system, the luminance values have constant ratio steps.

A general formula for nine manual brightness steps is as follows:

$$B_{COMMAND}=\frac{B_{\mathrm{MAX}}}{(B_{\mathrm{MAX}}/B_{\mathrm{MIN}})^{((9-SNS)/8)}} \quad \text{(Eqn. 12)}$$

where $B_{MAX}$ and $B_{MIN}$ are the maximum and minimum brightness values, SNS is the number of the manual brightness step, and $B_{COMMAND}$ is the luminance value, which may be a digitized power signal and may be used as the command brightness signal. This general formula may be adapted for use with other numbers of SNS and may be applied to the brightness values for day and night operation. In one aspect, the daytime display luminance or brightness is in the range of about 50 through about 512 nits and the nighttime display luminance or brightness is in the range of about 0.5 nits through about 60 nits. A microprocessor (not shown) may calculate the $B_{COMMAND}$ for a particular SNS. Alternatively, a look-up table may be provided in a memory or similar device (not shown). In one aspect, Table 2 is the look-up table.

In the automatic adjustment portion 330, an ambient light sensor 332 provides an analog signal to a logarithmic amplifier 334. The analog signal corresponds to the ambient light impinging the surface of a display panel. The ambient light sensor 332 and the logarithmic amplifier 334 may comprise a logarithmic sensor 314 as previously discussed. The logarithmic sensor 314 senses ambient light in a logarithmic fashion, providing a logarithmic sensor signal to an analog-to-digital (A/D) converter 336. The A/D converter 336 converts the analog logarithmic sensor signal into a digitized sensor signal. An average filter 338 performs a running average of the digitized sensor signal. In one aspect, an average digitized sensor signal is obtained from four sequential digitized sensor signals. The average filter 338 provides the average digitized sensor signals to a day/night comparator 340 and an automatic day selector 348.

From the average digitized sensor signal, the day/night comparator 340 determines whether a nighttime ambient light condition exists. A threshold signal level with hysteresis separates the nighttime and daytime ambient light conditions and may be calculated or determined empirically. The day/night comparator 340 determines nighttime ambient light conditions exist when the average digitized sensor signal remains below the threshold signal level for a predetermined time period. In one aspect, the predetermined time period is ten seconds. The day/night comparator 340 may have or may not have time input from a counter or other timing device (not shown) to measure of the predetermined amount of time. The day/night comparator 340 determines daytime ambient light conditions exist when a hysteresis point is exceeded. In one aspect, the hysteresis point is five brightness steps above the brightness step for the threshold signal level. Daytime ambient light conditions also may exist when the average digitized sensor signal remains above the threshold signal level for one or more readings or for another predetermined time period. When a daytime ambient light condition exists, the day/night comparator 340 sends a "DAY" determination to the day/night selector 344. When a nighttime ambient light condition exists, the day/night comparator 340 sends a "NIGHT" determination to the day/night selector 344. The brightness control system may have one or more sensors to indicate what other lights or illuminated display panels are activated and the level of activation. The sensors may be a control or other electronic signal. In one aspect, an instrument panel dimming control and headlight switch 342 determines the dimming level of the instrument panel (not shown) and whether the headlights (not shown) are turned-on. The instrument panel and headlight control/switch 342 provides the dimming level of the instrument panel to an automatic night selector 346. The instrument dimming control commands step number that the automatic night selector 346 is to use. In addition, a user offset SNS from brightness selection decode 324 may be used to "fine tune" the control of the display brightness during automatic night mode of operation. The instrument panel and headlight control 342 provides a control signal to the day/night selector 344 regarding whether the headlights are turned-on.

The brightness selection decoder 324 provides the operating mode—automatic, manual day, or manual night. When a manual mode is selected, the day/night selector 344 overrides the automatic operation and selects "Day" or "Night" per the user mode selection. When a user selects the automatic mode or when the automatic mode is the default power-up condition, the "Day" or "Night" determination depends upon whether the headlights are turned-on and the input from the day/night comparator 340. In one aspect, Table 3 illustrates the operation of the day/night selector 344.

TABLE 3

| Day/Night Determination | | | |
|---|---|---|---|
| Mode | Headlights | Day/Night Comparator | Output |
| Manual Night | n/a | n/a | NIGHT |
| Manual Day | n/a | n/a | DAY |
| Auto | On | Night | NIGHT |
| Auto | On | Day | DAY |
| Auto | Off | n/a | DAY |

In the automatic or auto mode, if the headlights are "On" and the day/night comparator 340 indicates a "Night" ambient light condition, the day/night selector 344 determines the "Night" brightness levels are to be used. In the automatic or auto mode, if the headlights are "On" and the day/night comparator 340 indicates a "Day" ambient light condition, the day/night selector 344 determines the "Day" brightness levels are to be used. The selection of the "Day" brightness levels allows the user to turn the lights on during daytime lighting conditions without having the backlight display device dim to a nighttime luminance level. If the headlights are "Off", the day/night selector 344 determines the "Day" brightness levels are to be used. If the lights are left off as the ambient brightness decreases, the automatic brightness control may continue to operate and may decrease the display luminance. If the headlights are turned-on when operating in an automatic brightness range below the threshold signal level, the display luminance may immediately decrease to nighttime operation.

The automatic night selector 346 determines the automatic night brightness or luminance value, which may be selected from the automatic night luminance values shown in Table 1 as commanded by the instrument dimming control. A user may "fine tune" the night luminance level by one or more steps via the SNS value from the brightness selection decode 324. In one aspect, when the automatic mode is selected or defaulted to at power up, the previous user selection is used unless changed by the user. The automatic night selector 346 provides the automatic night luminance value to the automatic day/night multiplexer 350.

The automatic day selector 348 determines the automatic day brightness or luminance value, which may be selected from the automatic day luminance values shown in Table 1 as previously discussed. The automatic day selector 348 also may have a filter to reduce or eliminate fluttering that may result from rapid changes in ambient light conditions. Large changes in ambient light may indicate an abnormal shadowing event such as hands, trees, buildings, and the like. Continuous or rapid ambient light changes may cause "picket fence" or "breathing" display effects. In one aspect, the filter determines how many steps are between the desired luminance level and the current display luminance. The number of steps is multiplied by a time constant to determine a delay period before stepping towards the desired brightness step. Subsequent steps toward the desired brightness step may be in 1-step or other increments. The automatic day selector 348 may have or may use a counter or other timing device to measure the time constant. If ambient light changes are large, the filter may cause the backlight display device to wait a longer time before changing the brightness. If the ambient light change is small, the delay period also is small. Small changes in ambient luminance may indicate a more permanent or "true" change in ambient light conditions since the sunlight ambient lighting changes are slow in nature. The automatic day selector 348 provides the automatic day luminance value to the automatic day/night multiplexer 350.

The automatic day/night multiplexer 350 selects the automatic luminance value based on the "DAY" or "NIGHT" determination provided by the day/night selector 344. If a "DAY" determination, the automatic day/night multiplexer 350 provides the automatic day luminance value to the manual/auto multiplexer 352. If a "NIGHT" determination, the automatic day/night multiplexer 350 provides the automatic night luminance value to the manual/auto multiplexer 352.

The manual/automatic multiplexer 352 selects either the automatic day or night luminance value provided by the automatic day/night multiplexer 350 or the manual day or night luminance value provided by the manual brightness selector 326. The manual/automatic multiplexer 352 uses the mode provided by the brightness selection decoder 324 to select the luminance value for the digitized command brightness signal. If the mode is automatic, the automatic luminance value is selected. If the mode is manual, the manual luminance value is selected.

The brightness controls system may be used in backlight display devices for automotive and similar applications, especially in devices utilizing active matrix liquid crystal displays such as a navigation radio and the like. The control of the display luminance as a power function of the display illuminance may decrease the display luminance during daylight conditions to a lower level suitable for comfortable viewing and may increase the battery operating times for portable devices incorporating backlit or emissive displays. Reducing the display luminance may increase operating life of a cold cathode fluorescent lamp or other types of backlights, or may increase the operating life and decrease image burn-in of emissive displays. Reducing the display luminance also may control the display luminance for optimum viewing brightness. Additionally, a user may not have an objectionably bright display under low-level ambient light conditions. The user adjustable aspects of the automatic brightness control system may cover various individual brightness preferences and the wide dynamic range of automotive ambient light conditions.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. A display device having an automatic brightness control system, comprising:

a lighted display;

a sensor disposed to logarithmically sense ambient light near the lighted display; and control circuitry connected to receive a first signal from the light sensor, the control circuitry connected to provide a display luminance to the lighted display, where the control circuitry selects the display luminance from at least one luminance adjustment sequence, where each luminance adjustment sequence has a plurality of luminance values with constant ratio steps, and where the display luminance is controlled by a transfer function that includes a term having a power relation to the ambient light near the lighted display and where an exponent of the term is a fraction.

2. The display device according to claim 1, where the fractional power function is adjusted by a constant ratio offset.

3. The display device according to claim 1, where the control circuitry further comprises digital-to-analog converter (DAC) circuitry, where the DAC circuitry converts the luminance value into an analog signal.

4. The display device according to claim 1, where the control circuitry comprises at least one digital to analog converter (DAC) connected to provide the display luminance to the lighted display, where the sensor provides the first signal with essentially equal DAC increments to the DAC, where the DAC increments correlate to constant ratio steps.

5. The display device according to claim 1, where the display luminance provides a brightness level according to the equation, $$B = Bo \cdot \left[\frac{B\max}{B\min}\right]^{((SNS-So)/(T-1))} \cdot BGL^{C}$$

where B is a display emitted luminance, Bo is a constant corresponding to a brightness offset on a log-log plot of the relationship between the display emitted luminance and the display background illuminance, Bmax is a maximum display brightness, Bmin is a minimum display brightness, SNS is a selected step number, $S_O$ is a midpoint of an SNS range, T is a total number of brightness steps, BGL is a display background luminance due to reflected ambient light, and C is an exponent describing the slope on a log-log plot of the relationship between the display emitted luminance and the display background illuminance.

6. The display device according to claim 5, where the relationship between the display emitted luminance and the display background illuminance is according the equation, $B=Bo \cdot BGL^{C}$.

7. The display device according to claim 5 where C is in the range of about 0 through about 1.

8. The display device according to claim 5, where C is a positive fraction.

9. The display device according to claim 1, where the lighted display further comprises:

a display panel; and a backlight operatively disposed adjacent to the display panel.

10. The display device according to claim 9, where the display panel is an active matrix liquid crystal display.

11. The display device according to claim 9, where the backlight comprises at least one of a cold cathode fluorescent lamp, and electro-luminescent lamp, and a light emitting diode (LED).

12. The display device according to claim 1, where the lighted display is a backlit display.

13. The display device according to claim 1, where the lighted display is a frontlit display.

14. The display device according to claim 1, where the lighted display is an emissive display.

15. The display device according to claim 1, where the lighted display comprises a pixel light source.

16. The display device according to claim 15, where the pixel light source comprises a light emitting diode.

17. The display device according to claim 1, where the sensor is a logarithmic sensor.

18. The display device according to claim 17, where the logarithmic sensor comprises a logarithmic amplifier connected to a photodiode.

19. The display device according to claim 1, where essentially all the luminance values have constant ratio steps in the luminance adjustment sequence.

20. The display device according to claim 1, where the control circuitry determines a first display luminance value from a first luminance adjustment sequence, the first display luminance corresponding to the first signal from the light sensor, where the control circuitry determines a second display luminance value from a second luminance adjustment sequence, the second display luminance value corresponding to a user brightness selection, and where the control circuitry selects the display luminance from one of the first and second display luminance values.

21. The display device according to claim 1, where a look-up table provides the at least one luminance adjustment sequence.

22. The display device according to claim 1, where the control circuitry calculates at least one of a look-up table and the luminance value, the look-up chart to provide the at least one luminance adjustment sequence.

23. The display device according to claim 22, where the control circuitry further comprises at least one microprocessor to calculate at least one of the look-up table and the luminance value.

24. The display device according to claim 1, further comprising a bezel having a surface adjacent to the display panel, and where the sensor is disposed on the surface.

25. The display device according to claim 1, where the display device is part of a navigation radio.

26. The display device according to claim 1, where the control circuitry comprises at least one integrated circuit (IC) chip.

27. The display device according to claim 1, where the display device is connected to a remote control device.

28. The display device according to claim 1, where the display device comprises a display of an electronic device.

29. The display device according to claim 28, where the electronic device is one of a communication device, a personal computer, and a personal organizer.

30. A display device having an automatic brightness control system, comprising:

a lighted display;

a sensor disposed to logarithmically sense ambient light near the display panel;

a user interface; and control circuitry connected to receive a first signal from the sensor, the control circuitry connected to receive at least one user brightness selection from the user interface, the control circuitry connected to provide a display luminance to the lighted display, where the control circuitry selects the display luminance from at least one luminance adjustment sequence, where each luminance adjustment sequence has a plurality of luminance values with constant ratio steps, where the display luminance is controlled by a transfer function that includes a term having a power relation to the ambient light near the lighted display and where an exponent of the term is a fraction and, where the transfer function is adjusted by a constant ratio offset based on the at least one user brightness selection.

31. The display device according to claim 30, where the control circuitry comprises at least one digital to analog converter (DAC) connected to provide the display luminance to the lighted display, where the sensor provides the first signal with essentially equal DAC increments to the DAC, where the DAC increments correlate to constant ratio steps.

32. The display device according to claim 30, where the display luminance provides a brightness level according to the equation, $$B = Bo \cdot \left[\frac{B\max}{B\min}\right]^{((SNS-So)/(T-1))} \cdot BGL^{C}$$

where B is a display emitted luminance, Bo is a constant corresponding to a brightness offset on a log-log plot of the relationship between the display emitted luminance and the display background illuminance, Bmax is a maximum display brightness, Bmin is a minimum display brightness, SNS is a selected step number, $S_O$ is a midpoint of an SNS range, T is a total number of brightness steps, BGL is a display background luminance due to reflected ambient light, and C is an exponent describing the slope on a log-log plot of the relationship between the display emitted luminance and the display background illuminance.

33. The display device according to claim 32, where the relationship between the display emitted luminance and the display background illuminance is according to the equation, $B=Bo \cdot BGL^{C}$.

34. The display device according to claim 32 where C is in the range of about 0 through about 1.

35. The display device according to claim 32, where C is a positive fraction.

36. The display device according to claim 30, where the control circuitry determines a first luminance value from a first luminance adjustment sequence, the first luminance value corresponding to at least one of the first signal and a first user brightness selection, where the control circuitry determines a second luminance value from a second luminance adjustment sequence, the second luminance value corresponding to at least one of the first signal and a second user brightness selection, where the control circuitry selects the display luminance from one of the first and second luminance values, and where the constant luminance ratio offset is based on one of the first and second user brightness selections.

37. The display device according to claim 30, where the control circuitry calculates at least one of a look-up chart and the luminance value, the look-up chart to provide the at least one luminance adjustment sequence.

38. The backlight display device according to claim 30, further comprising a bezel having a surface adjacent to the display panel, where the sensor is disposed on the surface, and where the user interface is disposed on the bezel.

39. The display device according to claim 30, where the control circuitry selects the luminance value from a manual luminance adjustment sequence when at least one user brightness selection includes a manual mode.

40. The display device according to claim 30, where the control circuitry selects the luminance value corresponding to a step number from a manual luminance adjustment sequence when at least one user brightness selection includes a manual mode and the step number selection.

41. The display device according to claim 30, where at least one user brightness selection includes one of a manual mode and an automatic mode and provides a determination of one of daytime and nighttime, where the control circuitry selects a manual night luminance value as the luminance value when at least one user brightness selection is a nighttime manual mode, the manual night luminance value provided by a manual night luminance adjustment sequence, where the control circuitry selects a manual day luminance value as the luminance value when at least one user brightness selection is a daytime manual mode, the manual day luminance value provided by a manual day luminance adjustment sequence, where the control circuitry selects an automatic night luminance value as the luminance value when the at least one user brightness selection is a nighttime automatic mode, the automatic night luminance value provided by an automatic night luminance adjustment sequence, and where the control circuitry selects an automatic day luminance value as the luminance value when the at least one user brightness selection is a daytime automatic mode, the automatic day luminance value provided by an automatic day luminance adjustment sequence.

42. A method for controlling the brightness of a display device, comprising:

(a) logarithmically generating a first signal in response to the ambient light associated with a lighted display;

(b) selecting a display luminance from at least one luminance adjustment sequence, each luminance adjustment sequence having a plurality of luminance values with constant ratio steps; and (c) providing the display luminance to a lighted display, where the display luminance is controlled by a transfer function that includes a term having a power relation to the ambient light associated with the lighted display where an exponent of the term is a fraction.

43. The method according to claim 42, where (a) further comprises:

sensing the ambient light on the display panel;

providing an analog signal in response to the ambient light; and logarithmically amplifying the analog signal to generate the first signal.

44. The method according to claim 42, further comprising providing the display luminance with a brightness level according to the equation, $$B = B0 \cdot \left[\frac{B\max}{B\min}\right]^{((SNS-So)/(T-1))} \cdot BGL^{C}$$

where B is a display emitted luminance, Bo is a constant corresponding to a brightness offset on a log-log plot of the relationship between the display emitted luminance and the display background illuminance, Bmax is a maximum display brightness, Bmin is a minimum display brightness, SNS is a selected step number, SO is a midpoint of an SNS range, T is a total number of brightness steps, BGL is a display background luminance due to reflected ambient light, and C is an exponent describing the slope on a log-log plot of the relationship between the display emitted luminance and the display background illuminance.

45. The method according to claim 44, where the relationship between the display emitted luminance and the display background illuminance is according to the equation, $B=Bo \cdot BGL^{C}$.

46. The method according to claim 42, where (b) further comprises:

determining a first luminance value from a first luminance adjustment sequence, the first luminance value corresponding to the first signal;

determining a second luminance value from a second luminance adjustment sequence, the second luminance value corresponding to at least one user brightness selection; and selecting the display luminance from one of the first and second luminance values.

47. The method according to claim 42, further comprising:

providing a determination of one of daytime and nighttime;

where if the determination is nighttime, selecting a night luminance value as the luminance value, the night luminance value provided by a night luminance adjustment sequence, the night luminance value corresponding to the step level commanded by the instrument dimming control or other nighttime control; and where if the determination is daytime, selecting a day luminance value as the luminance value, the day luminance value provided by a day luminance adjustment sequence, the day luminance value corresponding to the first signal.

48. The method according to claim 47, further comprising:

comparing the first signal to a threshold, where signals below the threshold indicate nighttime, where signals above the threshold indicate daytime;

where if the first signal is below the threshold, providing a nighttime determination; and where if the first signal is above the threshold, providing a daytime determination.

49. The method according to claim 47, where the display device is provided in a vehicle having at least one headlight, where the at least one headlight is turned-on.

50. The method according to claim 47, where the display device is provided in a vehicle having dashboard lights, and further comprising adjusting the night luminance value in response to a dimming level of the dashboard lights.

51. The method according to claim 47, further comprising filtering the day luminance to control fluttering from changes in the ambient light.

52. The method according to claim 42, where (b) further comprises selecting the luminance value from at least one luminance adjustment sequence provided on a look-up table.

53. The method according to claim 42, where (b) further comprises calculating at least one of a look-up table and the luminance value, the look-up table to provide the at least one luminance adjustment sequence.

54. A method for controlling the brightness of a display device, comprising:

(a) determining at least one user brightness selection;

(b) logarithmically generating a first signal in response to the ambient light near a lighted display;

(c) selecting a display luminance value from at least one luminance adjustment sequence, each luminance adjustment sequence having a plurality of luminance values with constant ratio steps;

(d) providing the display luminance to the lighted display, where the display luminance is controlled by a transfer function that includes a term having a power relation to the ambient light near the lighted display where an exponent of the term is a fraction; and (e) adjusting the transfer function by a constant luminance ratio offset based on the at least one user brightness selection.

55. The display device according to claim 54, further comprising providing the display luminance with a brightness level according to the equation, $$B = B0 \cdot \left[\frac{B\max}{B\min}\right]^{((SNS-So)/(T-1))} \cdot BGL^{C}$$

where B is a display emitted luminance, Bo is a constant corresponding to a brightness offset on a log-log plot of the relationship between the display emitted luminance and the display background illuminance, Bmax is a maximum display brightness, Bmin is a minimum display brightness, SNS is a selected step number, $S_O$ is a midpoint of an SNS range, T is a total number of brightness steps, BGL is a display background luminance due to reflected ambient light, and C is an exponent describing the slope on a log-log plot of the relationship between the display emitted luminance and the display background illuminance.

56. The display device according to claim 55, where the relationship between the display emitted luminance and the display background illuminance is according to the equation, $B=Bo \cdot BGL^{C}$.

57. The method according to claim 54, where (a) further comprises receiving the at least one user brightness selection from a user interface.

58. The method according to claim 54, where (c), when at least one user brightness selection includes a manual mode, further comprises selecting the display luminance from a manual luminance adjustment sequence.

59. The method according to claim 54, where (c), when the at least one user brightness selection includes a manual mode and a step number selection, further comprises selecting the display luminance corresponding to the step number selection on a manual luminance adjustment sequence.

60. The method according to claim 54, where step (c), when the at least one user brightness selection includes a manual mode, further comprises:

providing a determination of one of daytime and nighttime;

where if the determination is nighttime, selecting a manual night luminance value as the luminance value, the manual night luminance value provided by a manual night luminance adjustment sequence; and where if the determination is daytime, selecting a manual day luminance value as the luminance value, the manual day luminance value provided by a manual day luminance adjustment sequence.

61. The method according to claim 60, where the at least one user brightness selection provides the determination of one of daytime and nighttime.

62. The method according to claim 60, where step (c), when the at least one user brightness selection includes an automatic mode, further comprises:

providing a determination of one of daytime and nighttime;

where if the determination is nighttime, selecting an automatic night luminance value as the luminance value, the automatic night luminance value provided by an automatic night luminance adjustment sequence; and where if the determination is daytime, selecting a automatic day luminance value as the luminance value, the automatic day luminance value provided by an automatic day luminance adjustment sequence.

63. The method according to claim 54, where essentially all the luminance values have constant ratio steps in each luminance adjustment sequence.

* * * * *